United States Patent [19]

Scott-Jackson et al.

[11] Patent Number: 4,590,339

[45] Date of Patent: May 20, 1986

[54] JOYSTICK

[75] Inventors: Dennis L. Scott-Jackson, Burnaby; Grant N. Russell, New Westminster; Eric J. Richards, Burnaby, all of Canada

[73] Assignee: Gravis Computer Peripherals Inc., Burnaby, Canada

[21] Appl. No.: 702,575

[22] Filed: Feb. 19, 1985

[51] Int. Cl.[4] ..... H01H 25/00; G05G 9/04; H01C 10/16

[52] U.S. Cl. ..... 200/6 A; 74/471 XY; 338/128

[58] Field of Search ..... 74/471 XY; 200/6 A, 200/153 K; 338/128–134

[56] References Cited

U.S. PATENT DOCUMENTS

| | | | |
|---|---|---|---|
| 3,299,731 | 1/1967 | Russell, Jr. | 200/6 A X |
| 3,372,359 | 3/1968 | Wilson | 200/6 A X |
| 3,550,466 | 12/1970 | Ham | 74/471 XY |
| 3,918,021 | 11/1975 | Nishioka et al. | 338/128 |
| 4,275,611 | 6/1981 | Asher | 338/128 X |
| 4,469,330 | 9/1984 | Asher | 74/471 XY X |

*Primary Examiner*—J. R. Scott

*Attorney, Agent, or Firm*—D. Ron Morrison

[57] ABSTRACT

A joystick having a casing, a pair of gimbal plates mounted in the casing each slidable orthogonally with respect to the other and a pair of transducers, a control member of each coupled to a corresponding gimbal plate. A handle is coupled to the casing having a gimbal actuating sphere engaging each of the gimbal plates with the handle being universally pivotal throughout a portion of a spherical arc whose center lies intermediate the actuating sphere and an opposite end of the handle. Movement of the handle results in corresponding movement of the gimbal plates by an amount proportional to the component of displacement of the handle along the direction of movement of each of the gimbal plates. Each gimbal plate is biased so that it is urged towards a neutral position in the event of displacement on either side of the neutral position. External contacts are coupled to the transducers to allow the joystick to the electrically coupled to an external electrical line.

9 Claims, 6 Drawing Figures

JOYSTICK

BACKGROUND OF THE INVENTION

The present invention relates to a joystick for use in manually inputting coordinates and other information into computers and video equipment of various manufacturers.

The proliferation of different types of computers and video machines by various manufacturers has been accompanied by the development of associated joysticks to control input signals used to operate various games played on such machines. Generally, each different computer or video machine has a different arrangement of input lines and therefor requires a joystick which is compatible with its input requirements. Joysticks have been developed to include boxes having a plurality of rotatable input knobs to feed in coordinate information as well as buttons for activating microswitches that initiate events such as "fire" signals.

To facilitate the manual control of input coordinate information, joysticks having a handle simultaneously movable in two orthogonal directions were developed to more easily and conveniently determine coordinate information in two orthogonal directions. Known joysticks of such a type utilize internal mechanisms that result in a relatively bulky housing and a set biasing force on the handle to urge the latter towards a neutral position. Considering that joysticks are usually coupled to a computer or video machine by means of a cable, and are therefore positioned by the user on a portion of a table or the like in front of the monitor, a joystick housing occupying a minimum of space and having a minimum of thickness in order to maximize stability against tipping is highly desirable. Conventional joysticks which generally have relatively large vertical dimensions as compared to the horizontal dimensions are subject to tipping particularly when the handles have a relatively large biasing force.

In addition, considering that different users prefer different amounts of biasing on the joystick handle, conventional joysticks which have a set biasing force severely limit both the adaptability and the desirability of conventional joysticks.

SUMMARY OF THE INVENTION

According to the invention there is provided a joystick which includes a casing, a pair of gimbal plates mounted in the casing each slidable orthogonally with respect to the other, and a pair of transducers, the control member of each being coupled to a corresponding gimbal plate. The coupling of each control member to its corresponding gimbal plate is such that a change in position of each gimbal plate produces a proportional change in movement of a corresponding one of the control members. A handle is coupled to the casing and has a gimbal actuating sphere which engages each of the gimbal plates. The handle is universally pivotal throughout a portion of a spherical arc, the center of which lies intermediate the actuating sphere and the opposite end of the handle. Pivotal movement of the handle results in corresponding movement of the gimbal plates by an amount proportional to the component of displacement of the handle along the direction of movement of the corresponding gimbal plates. Contact means are coupled to the transducers for providing external electrical contacts thereto.

By utilizing slidable gimbal plates to transfer pivotal movement of the handle into radial movement of the control members of a pair of transducers, a joystick having a smaller vertical height than conventional joysticks is obtained.

Preferably the biasing means includes two pairs of opposed spring assemblies mounted on the casing with each pair urging an associated gimbal plate in opposite directions toward a neutral position.

A spring tensioning wheel rotatably mounted in the casing and engaging each of the spring assemblies may be employed such that upon rotation of the tensioning wheel, the biasing force applied to a corresponding gimbal plate is changed by an amount and in a direction depending on the amount and direction of rotation of the tensioning wheel. Provision of a tensioning wheel to adjust the biasing force on the handle is a feature not found in conventional joysticks but which optimizes the biasing force on the handle to suit a wide range of potential users.

Advantageously a spherical ball portion is formed on the handle with key means such that the center of the ball portion lies on the aforesaid spherical arc. A base plate mounted on the casing having a ball portion receptacle and keyway means engages the ball portion receptacle and key means, respectively. The key means and keyway means when engaged prevent rotation of the handle but permit its pivotal movement.

The casing may have a spring guide enclosure for each of the spring assemblies and each spring assembly may have a spring cup slidable in the spring guide. A coil spring acts as the biasing means with one end engaged in the spring cup and the other end contacting a cam ball. The tensioning wheel may have four cam surfaces disposed so that each one abuts a corresponding cam ball and such that upon rotation of the wheel, the associated cam surfaces either compress or permit expansion of the coil spring. The cups contact respective corresponding opposed edges of the gimbal plates so that upon compression or expansion of the spring a varying biasing force is applied to the associated gimbal plates. Thus, by mere rotation of the tensioning wheel, the biasing force on the gimbal plates may be selectably adjusted.

The tensioning wheel may have four radially spaced apart release regions where the cam surfaces are not in tension contact with the corresponding springs and the gimbal plates therefore, are unbiased.

The gimbal plates may be slidably mounted in the casing in parallel planes with central slots in each of the gimbal plates overlapping. A gimbal bushing may be slidably supported between the gimbal plates in the central slots with the gimbal bushing having a circular aperture for receiving the actuating end of the handle.

A plurality of microswitches may be mounted on the casing and a microswitch mounted at an end of the handle opposite the actuating end in order to provide "fire" control signal information. By utilizing a fire button at an end of the handle opposite the actuating end, a user may simultaneously with a single hand pivot the handle and at the same time with his thumb press the button switch on the distal end of the handle. In this way, a plurality of functions may be performed by only one hand in a much more convenient but rapid fashion.

The gimbal plates each may have a pair of elongated slots engaging corresponding posts on the casing which thereby constrain the gimbal plates to linear sliding movement. A U-shaped slot on one side edge of each of the plates which is parallel to the direction of sliding movement of the corresponding plate may engage a lever arm coupled to a control member of a corresponding transducer. Upon movement of the gimbal plate the lever arm is caused to pivot in response to movement of the corresponding U-shaped slot which receives that lever arm, thereby resulting in movement of the control member of the corresponding transducer. Thus, movement of the handle results in movement of the control member of the transducers in proportion to the amount of pivoting movement in either one of the two orthogonal directions of sliding movement of each of the gimbal plates.

The joystick may further include a plurality of rotary switches which extend through the casing, a printed circuit board mounted on the casing and having a plurality of contact pads selectively contactable with contacts on the switches. In this way the circuit configuration within the joystick may be varied depending upon user requirements.

The transducers may be a pair of potentiometers.

BRIEF DESCRIPTION OF THE DRAWINGS

In drawings of a preferred embodiment of the invention.

BRIEF DESCRIPTION WITH REFERENCE TO THE DRAWINGS

In the following description, like reference numbers in the different figures represent like parts. Moreover, terms such as upper, lower, bottom and top are used in a relative sense only rather than in an absolute sense.

Figure 1:
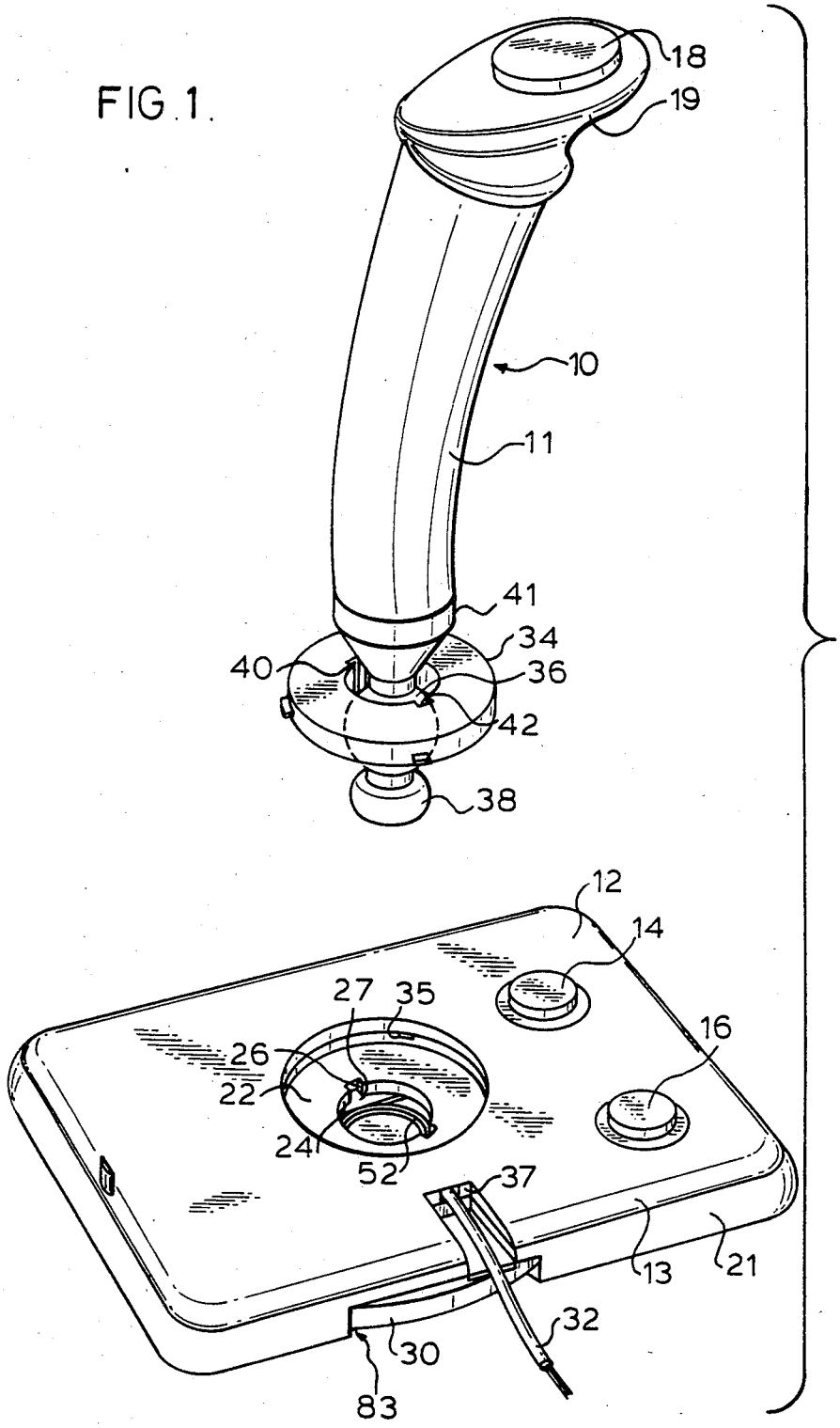
FIG. 1 is a perspective view showing the casing and the handle in exploded form.
Figure 2:
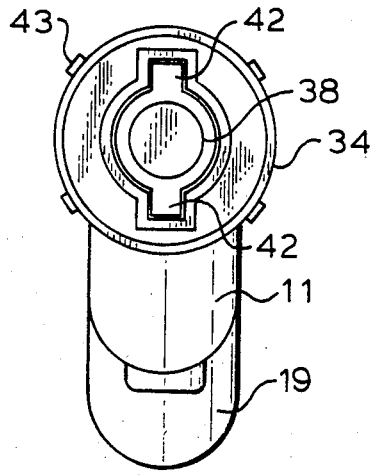
FIG. 2 is a front elevation view of the handle and handle collar.

The joystick as shown in FIG. 1, in exploded form, consists of a handle 10 coupled to a casing 12 having an upper casing section 13 and a bottom casing section 21. The handle 10 includes a padded handle grip 11, a thumb button housing 19 at the top of which is located a thumb microswitch button 18. Below the handle grip 11 is a handle housing 41 which supports a handle ball 36 having two oppositely disposed ball pins 42 and a gimbal ring actuating sphere 38.

Figure 3:
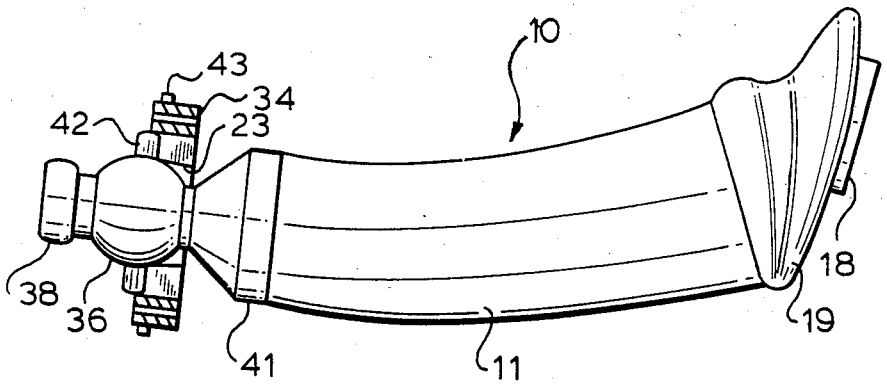
FIG. 3 is a side elevation view of the handle with the collar in section.

An annular handle collar 34 fits between handle housing 41 and handle ball 36. Collar 34 includes a pair of oppositely disposed ball pin collar slots or keyways 40 which slidably receive ball pins or keys 42. As shown in FIG. 3, collar 34 has a sloped interior surface 23 which abuts ball 36 and permits pivotal motion of the handle 10 in a spherical arc but prevents rotation thereof when the pins 42 are engaged with slots 40.

Figure 4:
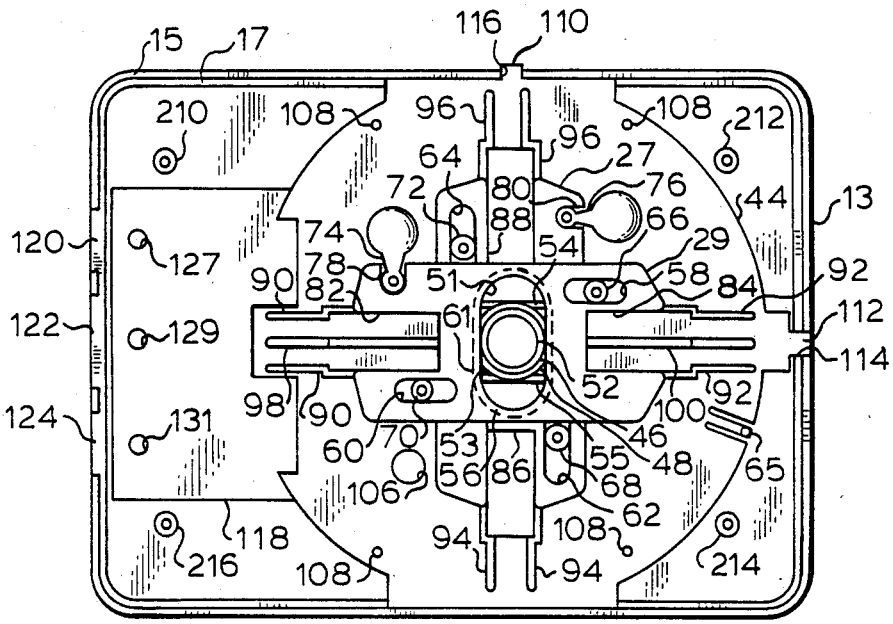
FIG. 4 is a bottom view of the casing assembly showing the gimbal plates and printed circuit board.

Casing 12 houses a base plate 44 (see FIGS. 4 and 5) which has a collar receptable 22 formed on an upper surface thereof and a ball-base plate contact surface 24 which contacts ball 36. Contact surface 24 has formed therein two oppositely disposed ball pin base plate slots or keyways 26 dimensioned and positioned to slidably receive ball pins or keys 42. Below the base plate 44 is mounted a pair of gimbal plates 27 and 29 (see FIG. 4). Annular gimbal ring or bushing 52 is mounted between a pair of overlapping central plate openings 51 and 53 as shown in FIG. 4. Actuating sphere 38 passes into annular ring 52 and engages the latter.

Collar 34 has a plurality of radially spaced apart receptacle keys 43 which are positioned and dimensioned to be snugly slidably received in receptacle keyways 35. A pair of firing buttons 14 and 16 are mounted on the casing to actuate microswitches 136 and 138 (see FIG. 5) located within the casing 12. A cable 32 housing a plurality of electrical leads passes into the casing 12 through a cable guard 37 that prevents movement of the cable 32 into or out of the casing 12. The tensioning wheel 30 is rotatably mounted within the casing 12 and extends through slots 81 and 83 in the latter to provide adjusting surface portions thereof.

As shown in FIG. 4, a base plate 44 is mounted in an upper casing section 13 being positioned in the upper casing section 13 by means of a locate lip or positioning tab 110 snugly, slidably insertable into a lip or tab receptacle 116 in casing section 13 and a locate or positioning plug 112 snugly, slidably insertable into a plug receptacle 114. At one end of the base plate 44 there is affixed a printed circuit board 118 having three rotary wheel apertures 127, 129 and 131. The bottom edge of the upper casing section 13 has an upper casing rim 15 which extends below an upper casing shoulder 17 adjacent to, but interior with respect to the rim 15.

Three rim slots 120, 122 and 124 are formed opposite the corresponding rotary wheel apertures 127, 129 and 131, respectively.

Figure 5:
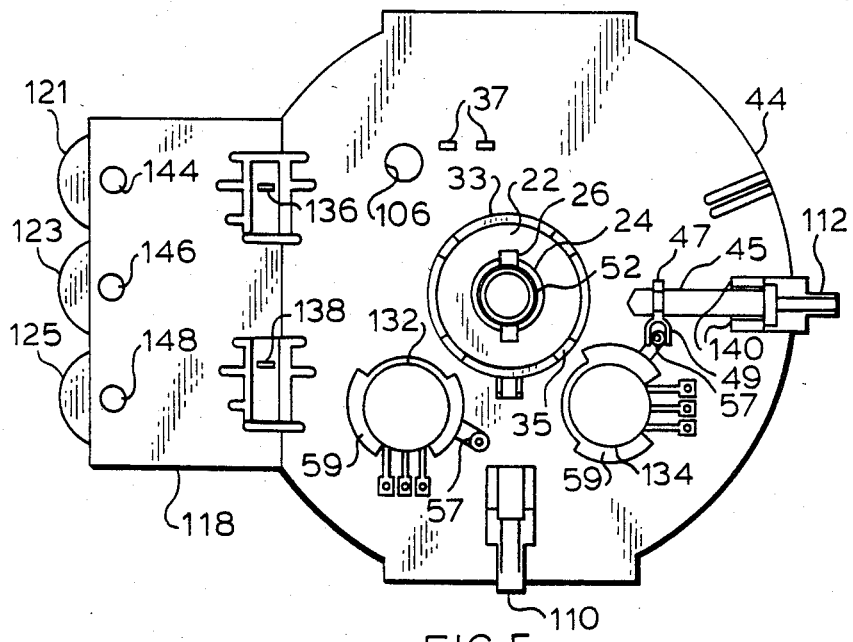
FIG. 5 is a plan view of the base plate and printed circuit board.

The bottom surface of base plate 44 has four radially disposed wheel guide pins 108. Also formed in the bottom of base plate 44 are a plurality of radially outwardly directed base plate spring walls 90, 92, 94 and 96. Intermediate spaced apart walls 90 and 92 are central positioning ribs 98 and 100, respectively. A pair of orthogonally disposed gimbal plates 27 and 29 each have a pair of arcuate slots 64 and 62, and 58 and 60, respectively formed therein. Posts 66, 68, 70 and 72, respectively slidably fit through corresponding slots 58, 60, 62 and 64, respectively. Thus, the gimbal plates 27 and 29 are orthogonally slidable with respect to one another. Each of gimbal plates 27 and 29 has a pair or opposed rectangular slots 86 and 88, and 82 and 84, respectively. Along an edge parallel to the direction of sliding movement in each of corresponding gimbal plates 27 and 29 is formed a U-shaped slot 78 and 80, respectively, which slots are adapted to slidably receive an end of lever arms 74 and 76, respectively. Lever arms 74 and 76 are coupled to the wiper arms of potentiometers 132 and 134 as shown in FIG. 5. Thus, rotation of the lever arms 74 and 76 causes movement of corresponding wiper arms of potentiometers 132 and 134, respectively.

Lower gimbal plate 29 has a central outer opening 61 and a concentric slightly smaller inner opening 51 joined by a lower gimbal plate shoulder 56. Similarly, a spaced apart upper gimbal plate 27 has an upper gimbal plate shoulder 54 joining an outer opening 55 and a concentric inner opening 53.

Gimbal ring or bushing 52 has a pair of oppositely disposed small sleeves 46 and a single central large sleeve 48. Large sleeve 48 is slidable on shoulders 54 and 56, respectively. Four posts 210, 212, 214 and 216 are spaced proximate the corners of upper casing section 13. A hole 106 in base plate 44 provides an access port for leading electrical cable from one side of base plate 44 to the other.

The upper surface of base plate 44, as illustrated in FIG. 5, contains a cylindrical collar receptacle wall 33 forming a collar receptacle 22 with the latter having a ball-base plate contact surface 24. Four radially, equally spaced receptacle keyways are located in the collar receptacle wall 33 and accomodate receptacle keys 43.

Locate or positioning plug 112 is formed so as to accomodate an adjusting screw 45 between two spacing legs 140. On a threaded end of screw 45 is registered a nut 47 having a fork end 49. Fork end 49 fits into a slot (not shown) in a post 57 which prevents rotational movement of nut 47 in response to rotation of screw 45. Post 57 is integral with a sleeve 59 capturing potentiometer 134 in a firm, non-slipping engagement. A similar arrangement (not shown) is used with respect to locate lip or positioning tab 110 and potentiometer 132.

Printed circuit board 118 has mounted thereto a pair of microswitches 138 and 136 on top of which are placed firing buttons 16 and 14, respectively. Rotary wheel switches 121, 123 and 125 having wheel axles 144, 146 and 148, respectively are mounted against the printed circuit board 118 with the axles 144, 146 and 148 slidably inserted through apertures 127, 129 and 131, respectively. A pair of contacts on each wheel 121, 123, and 125 (not shown) are used to contact a set of three different pads (not shown) on printed circuit board 118.

On the periphery of base plate 44 (as shown in FIGS. 4 and 5) is a tension ring button 65 formed at the end of a finger in the base plate 44.

Figure 6:
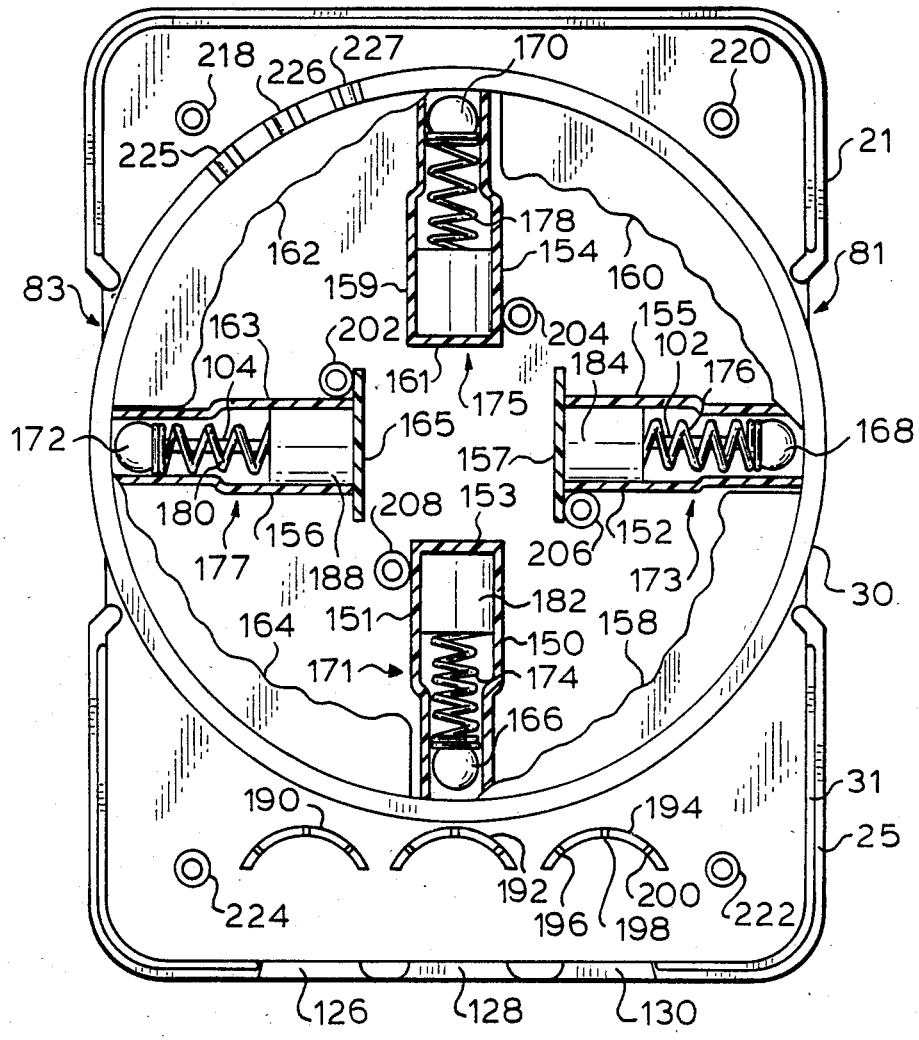
FIG. 6 is a plan view showing the spring assemblies and tensioning ring as mounted in a bottom casing section.

The tensioning wheel 30 is shown in FIG. 6 as it is mounted on a bottom casing section 21. An upper annular surface of wheel 30 rotates around the outside of wheel guide pins 108 on base plate 44 as shown in FIG. 4 and around corresponding ridges (not shown) in the bottom casing section 21. On the interior cylindrical surface of the tensioning wheel 30 there is a set of four radially spaced integral cams 158, 160, 162 and 164 having generally serpentine cam surfaces. On the bottom casing there is formed a set of four equally, radially spaced apart spring wells 171, 173, 175 and 177, generally directed toward a center of the tensioning wheel 30 and interior thereof. Spring well 171 is formed by vertical walls 150, 151 and 153; spring well 173 is formed by vertical walls 152, 155, and 157; spring well 175 is formed by vertical walls 154, 159 and 161; while spring well 177 is formed by vertical walls 156, 163 and 165. The walls 150 and 151 align with walls 90 on the base plate; walls 152 and 155 align with walls 96; walls 154 and 159 align with walls 92; and walls 156 and 163 align with walls 94. Sufficient space is allowed between the sets of aligned walls to permit gimbal plates 27 and 29 to slide back and forth. Spring wells 171, 173, 175 and 177 each have spring cups 182, 184, 186 and 188 slidably contained therein. Coil springs 174, 176, 178 and 180 are inserted into corresponding respective cups 182, 184, 186 and 188 and at an opposite end contact ball bearings 166, 168, 170 and 172, respectively. Radial edges of cams 158 and 162 contact walls 152 and 163, respectively, at one end of the adjustment position. The wheel 30 is rotatable in a clockwise direction as shown in FIG. 6. Casing 21 has an interior bottom casing rim 31 which extends beyond a bottom casing shoulder 25 and abuts top casing rim 15. Three rotary wheel bottom section rim slots 126, 128 and 130 are formed in bottom casing section 21 and coincide with corresponding slots 124, 122 and 120, respectively, of the top casing section 13. Three rotary switch support walls 190, 192 and 194 each forming a portion of a cylindrical wall are located proximate corresponding slots 126, 128 and 130, respectively. Each support wall has three notches 196, 198 and 200 formed therein at radially spaced apart positions in the top edge thereof for contacting a corresponding detent in each of wheels 121, 123 and 125 in order to mark the three separate switch positions. (The detent in wheels 121, 123 and 125 are not shown.) Four bottom casing posts 218, 220, 222 and 224 disposed proximate each of the four corners of the bottom casing section 21 register with corresponding top casing posts 214, 212, 210 and 216, respectively. Screws passing through the posts 218, 220, 222 and 224 threadedly register with threaded holes in corresponding top casing posts 214, 212, 210 and 216, respectively. Base plate 44 is affixed to bottom casing 21 by means of casing posts 202, 204, 206 and 208 which register with gimbal plate guide posts 68, 66, 72 and 70 respectively. Screws passing through posts 202, 204, 206 and 208 having threads which register with threaded receptacles in base plate guide posts 68, 66, 72 and 70, respectively are used to affix the base plate 44 to the bottom casing section 21. Spaced apart grooves 225, 226 and 227 in a top surface of tensioning wheel 30 successively engage tension ring button 65 on base plate 44 in the first three tension settings.

Formed in each long side of casing section 21 are a pair of tensioning wheel slots 81 and 83 which are used to provide user access to the tensioning wheel 30.

In operation, when handle 10 is tilted in a particular direction, ball 36 rotates against collar ball contact surface 23 and ball base plate contact surface 24. At the same time cylindrical pins 42 rotate and pivot vertically in ball pin base plate slots 26 and ball pin collar slots 40. Gimbal ring actuating sphere 38 forces gimbal ring 52 against upper and lower gimbal plate openings 53 and 51, respectively. In response, gimbal plates 27 and 29 each move in a direction determined by the movement of actuating sphere 38. Gimbal plate 27 is constrained to move in a linear direction as determined by the contact of gimbal plate slots 62 and 64 against guide posts 68 and 72, respectively. Similarly, gimbal plate 29 moves in a direction constrained by the movement of slots 58 and 60 past guide posts 66 and 70, respectively. Movement of gimbal plates 27 and 29, in turn, result in U-shaped slots 80 and 78 pivoting potentiometer coupling arms 76 and 74, respectively. The latter pivoting arms are coupled to the wiper arms (not shown) of potentiometers 134 and 132, respectively. Thus, movement of each wiper arm of each potentiometer 132 and 134 is proportional to the displacement of the handle along the direction of movement of each of the gimbal plates 27 and 29, respectively. A zero adjustment of the potentiometer wiper arm of each potentiometer 132 and 134 may be obtained by adjustment of a corresponding adjusting screw 45 such as that of potentiometer 134 shown in FIG. 5.

As screw 45 is rotated, nut 47 travels along the threaded portion thereof thereby moving the casing of potentiometer 134. The wiper arm at the same time is held in a fixed position by means of the U-shaped slot 80 of gimbal plate 27. A similar adjustment is available for potentiometer 132.

In the event a user desires a change in biasing on the handle 10, this is accomplished by rotation of tensioning wheel 30. As tensioning wheel 30 rotates in a clockwise position as shown in FIG. 6, cams 158, 160, 162 and 164 begin to engage ball bearings 166, 168, 170 and 172, respectively, forcing the latter to compress associated springs 174, 176, 178 and 180, respectively. This in turn causes a compression force to be generated against associated spring cups 182, 184, 186 and 188, respectively. Spring cups 182 and 186 contact gimbal plate 29 at slots 82 and 84, respectively, thereby applying opposing biasing forces to the latter. Similarly, spring cups 184 and 188 contact gimbal plate 27 at slots 86 and 88, respectively. The more tensioning wheel 30 is rotated in a clockwise direction, the more compression is applied to coil springs 174, 176, 178 and 180, thereby providing a greater biasing of gimbal plates 27 and 29 when moved from their neutral position. Alternatively, spring biasing can be disconnected altogether from the handle by simply rotating tension wheel 30 in a complete counterclockwise direction until cam surfaces 162 and 158 abut walls 163 and 152, respectively.

As seen in FIG. 5, microswitches 138 and 136 are included to provide firing buttons. Similarly, button 18 as shown in FIG. 1 at the top end of handle 10 is provided as a fire button operable by the thumb of a user of the same hand that is used to manipulate handle 10. Button 18 actuates a microswitch (not shown) located inside thumb button housing 19. Handle 10 is hollow to permit wires to connect to the latter microswitch (not shown).

Initially, rotary wheel switches 121, 123 and 125 are rotated to a desired position depending on the particular machine with which the joystick is to be used. Secondly, tensioning wheel 30 is adjusted to provide the desired biasing force to handle 10.

The layout of the printed circuit board 118 may have any number of alternative configurations. The purpose of the printed circuit board is to permit simple wiring of the latter to accomodate any particular machine. In the present case the printed circuit board may be set out to accomodate the three most popular machines and the rotary wheel switches 121, 123 and 125 used to switch from one type of machine to the other.

The resultant assembly which does not involve the use of any components which have a significant vertical dimension is a low profile casing highly stable against tipping.

Other variations, modifications and departures lying within the spirit of the invention and scope as defined by the appended claims will be obvious to those skilled in the art.

I claim:

1. A joystick comprising:

(a) a casing;

(b) a pair of gimbal plates mounted in said casing, each slidable orthogonally with respect to the other;

(c) a pair of transducers, a control member of each coupled to a corresponding gimbal plate such that a change in position of each gimbal plate produces a proportional change in movement of a corresponding one of said control members;

(d) a handle coupled to said casing having a gimbal actuating sphere engaging each of said gimbal plates, said handle universally pivotal throughout a portion of a spherical arc whose center lies intermediate said actuating sphere and an opposite end of said handle, such that movement of said handle results in corresponding movement of said gimbal plates by an amount proportional to the component of displacement of said handle along the direction of movement of said corresponding gimbal plates;

(e) biasing means coupled to each of said gimbal plates urging each of said gimbal plates towards a neutral position, said biasing means including two pairs of opposed spring assemblies mounted on said casing, each pair urging an associated gimbal plate in opposite directions towards a neutral position;

(f) contact means coupled to said transducers for providing external electrical contacts thereto; and (g) a spring tensioning wheel rotatably mounted in said casing, said wheel having sectorized progressive contoured cam means engaging each of said spring assemblies such that on rotation of said tensioning wheel, the biasing force applied to a corresponding gimbal plate is changed by an amount and in a direction depending on the amount and direction of rotation of said tensioning wheel.

2. A joystick as defined by claim 1, including a spherical ball portion on said handle having key means, the center of said ball portion lying on the spherical arc, a base plate mounted in said casing having a ball portion receptacle and keyway means engaging said ball portion receptacle and key means, respectively, such that said key means and said keyway means when engaged prevent rotation of said handle but permit pivotal movement of said handle about the spherical arc portion.

3. A joystick as defined by claim 2, wherein said casing has a spring guide enclosure for each of said spring assemblies, and each spring assembly has a spring cup slidable in said spring guide, a coil spring having one end engaged with said spring cup, a cam ball contacting another end of said spring, said tensioning wheel having four cam surfaces disposed so that each one abuts a corresponding cam ball and upon rotation of said wheel compresses or permits expansion of said spring and wherein said cups contact respective corresponding opposed edges of said gimbal plates.

4. A joystick as defined by claim 3, wherein said tensioning wheel has four radially spaced apart release regions where said cam surfaces are released from said cam balls and said springs are uncompressed, thereby leaving the gimbal plates in an unbiased condition.

5. A joystick as defined by claim 4, wherein said gimbal plates lie in parallel planes and have central overlapping slots and including a gimbal bushing slidably supported between said gimbal plates in the central slots thereof, said gimbal bushings having a circular aperture for receiving the actuating arm of said handle.

6. A joystick as defined by claim 4, including a plurality of microswitches mounted on said casing and a microswitch mounted at an end of said handle opposite said actuating arm.

7. A joystick as defined by claim 4, wherein said gimbal plates each have a pair of elongated slots engaging corresponding posts on said casing thereby constraining said gimbal plates to linear sliding movement, a U-shaped slot on one side edge of each of said plates parallel to a direction of movement of corresponding plates, said transducers each having coupled to a control member thereof a lever arm, the lever arm being received by a corresponding U-shaped slot such that on movement of said gimbal plate said lever arm pivots and moves the wiper arm.

8. A joystick as defined by claim 4, including a plurality of rotary switches extending through said casing, a printed circuit board mounted on said casing and having a plurality of contact pads selectively contactable with contacts on said switches.

9. A joystick as defined by claim 1, wherein said transducers are potentiometers.

* * * * *